US007818850B2

(12) United States Patent
Billarant

(10) Patent No.: US 7,818,850 B2
(45) Date of Patent: Oct. 26, 2010

(54) MOULDED-OVER ARTICLE WITH A SMALL BAND COMPRISING HOOKS

(75) Inventor: Fabrice Billarant, Nantes (FR)

(73) Assignee: APLIX, Paris (FR)

( * ) Notice: Subject to any disclaimer, the term of this patent is extended or adjusted under 35 U.S.C. 154(b) by 85 days.

(21) Appl. No.: 10/688,483

(22) Filed: Oct. 17, 2003

(65) Prior Publication Data

US 2004/0128804 A1 Jul. 8, 2004

(30) Foreign Application Priority Data

Oct. 23, 2002 (FR) ..... 02 13217

(51) Int. Cl.
*A44B 18/00* (2006.01)

(52) U.S. Cl. ..... 24/306; 24/442; 428/99; 428/10; 428/120

(58) Field of Classification Search ..... 24/306, 24/442–444, 447, 450, 452; 428/99, 100, 428/119, 120, 900; 264/46.4, 46.7, 165, 264/167, 219, 271.1, 297.2, 328.8
See application file for complete search history.

(56) References Cited

U.S. PATENT DOCUMENTS

| | | | | |
|---|---|---|---|---|
| 5,058,245 | A | 10/1991 | Saito | 24/306 |
| 5,061,540 | A * | 10/1991 | Cripps et al. | 24/444 |
| 5,422,156 | A * | 6/1995 | Billarant | 428/100 |
| 5,688,576 | A * | 11/1997 | Ohno et al. | 24/442 |
| 6,439,537 | B1 * | 8/2002 | Fujisawa et al. | 249/85 |
| 6,460,230 | B2 * | 10/2002 | Shimamura et al. | 24/452 |
| 6,463,635 | B2 * | 10/2002 | Murasaki | 24/452 |
| 6,596,371 | B1 * | 7/2003 | Billarant et al. | 24/442 |
| 6,656,563 | B1 * | 12/2003 | Leach et al. | 428/100 |
| 6,720,059 | B2 * | 4/2004 | Fujisawa et al. | 24/442 |
| 6,803,010 | B2 * | 10/2004 | Leach et al. | 264/297.3 |
| 6,842,950 | B2 * | 1/2005 | Fleuchaus et al. | 24/442 |
| 7,108,904 | B2 * | 9/2006 | Itoh et al. | 428/99 |
| 2002/0031637 | A1 * | 3/2002 | Oborny et al. | 428/99 |

FOREIGN PATENT DOCUMENTS

| | | |
|---|---|---|
| EP | 1 118 443 | 7/2001 |
| FR | 2 423 666 | 11/1979 |
| WO | WO 98/02331 | 1/1998 |
| WO | WO 01/37694 | 5/2001 |

* cited by examiner

*Primary Examiner*—Robert J Sandy
(74) *Attorney, Agent, or Firm*—Renner, Kenner, Greive, Bobak, Taylor & Weber

(57) ABSTRACT

An article over which a moulding is to be made, aid moulded-over article comprising a base 2 having a top surface 6 and a bottom surface 4, hooks 3 extending from the bottom surface 4 of the base and metallic material fixed on the top surface of the base, the hooks 3 being disposed in a region in the form of a longitudinal strip, the base is flat in shape, the hook strip has a width less than 12 mm, preferably between 3 and 10 mm, and the flat base 2 is of a material such and of a thickness such that it can undergo deformation to follow the shapes of top edges of walls on which the article for moulding over is intended to be placed by its bottom surface.

17 Claims, 3 Drawing Sheets

MOULDED-OVER ARTICLE WITH A SMALL BAND COMPRISING HOOKS

TECHNICAL FIELD

This invention relates to an article which is intended to be fixed to an object moulded there over from a foam plastic, the moulded-over article consisting of a base, a top surface of which is intended to come into contact with the foam in order to be fixed there by solidification of the foam on said surface of the article for moulding over, the other surface having hooks disposed in a region in the form of an oblong strip.

BACKGROUND ART

Numerous moulded-over articles are known in this area. Generally, to fix the moulded-over article to the moulded object, a trench or cavity defined by walls projecting from the base of the mould is formed at the base of the mould in which the foam is poured to form the moulded object, the moulded-over article being placed on the outer top edges of said walls before the foam is poured. A magnet is placed in the bottom of the cavity defined by the projecting walls and the top surface of the moulded-over article is provided with a rib of metallic resin which, by magnetic co-operation with the magnet, holds the article for moulding over on the top edges of the walls of the cavity or trench, in order thus to keep the moulded-over article in position during the pouring of the foam.

However, the pressure of the poured foam is considerable. It is therefore necessary to seal the interface between the bottom surface and the top edges of the walls to prevent the foam from infiltrating inside the cavity and fouling the hooks which extend from the bottom surface of the moulded-over article. Another procedure is to provide a protective cocoon for the hooks, which is withdrawn by peeling after the withdrawal of the moulded object with the article moulded there over. These hooks, in fact, once the moulded object has been withdrawn with the moulded-over article fixed, will enable, for example, a fabric to be fixed by means of loops, in order to cover the moulded object, which can, for example, be a motor vehicle seat cushion. Generally, the base of the moulded-over article is provided with two upwardly inclined ramps to enable the moulded-over article to be clipped between two side walls. Obviously this system is complicated and takes time, and this gives rise to problems in installations for the production of moulded objects, for example motor vehicle seats. It is of course possible to provide additional means, such as a pre-solidified layer of foam which prevents the liquid from penetrating into the cavity by compression of the pre-solidified foam. It is also possible to provide bottom lips extending from the bottom surface and surrounding the hooks in order to protect the foam. These protective lips are complicated to manufacture.

DISCLOSURE OF THE INVENTION

The object of this invention is to obviate the above disadvantages of the prior art by proposing a novel moulded-over article which is very simple to make and very simple to use, particularly eliminating the need to clip it between two walls of the cavity or provide protective lips or other means for protecting the hooks or the interface with the top outer edges of the walls of the cavity on which the article is placed during its fixing to the moulded object.

According to the invention, an article for moulding over comprising a base having a top surface and a bottom surface, hooks extending from the bottom surface of the base and metallic material fixed on the top surface of the base, the hooks being disposed in a region in the form of a longitudinal strip, is characterized in that the base is flat in shape, the hook strip has a width less than 10 mm, preferably between 3 and 10 mm, and the flat base is of a material such and of a thickness such that it can undergo deformation to follow the shape or undulation of top edges of vertical walls on which the article for moulding over is intended to be placed by its bottom surface.

In this application, the width of the hook strip denotes the dimension corresponding, in perpendicular cross-section as in FIG. 1, to the distance between the point furthest to the right of the hook furthest on the right and the point furthest to the left of the hook furthest on the left. This refers to the width overall, particularly the minimum width that a cavity must have for the hooks to be able to penetrate therein.

Thus according to the invention an article for moulding over is obtained which, while being sufficiently flexible to follow any possible shapes of the top edges of vertical walls on which it is intended to be placed before hardening of a foam poured on to it at the bottom of a mould, will nevertheless have, when simply placed at the bottom of the mould on the top outer edges of the walls forming a cavity at the base of the mould, sufficient sealing at the area of contact between the wall edges and the bottom surface so that the foam cannot penetrate into the cavity and come into contact with the hooks. No additional sealing system is required at the level of this interface. The use of this article for moulding over and particularly its placing at the base of the mould and then the pouring of the foam thereon in order to produce the final moulded object including the moulded-over article is therefore particularly simple.

According to one specifically preferred embodiment, the hooks are made in the form of longitudinal rows, the number of rows preferably being less than or equal to 3, and the hooks have a Christmas tree shape.

The term Christmas tree denotes hooks having the following shape: a hook comprises a rod extending between a base and a head, the rod preferably being of cylindrical shape, particularly parallelepipedal, and at least one fin extending from the outer surface of the rod at a level intermediate the head and the base, the fin having a shape which is preferably curved towards the base to form a hook.

Preferably, the head is in the form of a ridge, the base of the ridge being of a larger size than that of the cross-section surface area of the rod in order thus to form one or more reinforcements in which loops can be engaged.

Preferably, the hook comprises two diametrically opposite fins.

According to one preferred embodiment, the longitudinal strip comprising hooks stops at a distance from the longitudinal ends of the base, longitudinal end regions thus being formed without hooks, particularly over a distance of some millimeters, particularly less than 15 mm, e.g. between 5 and 12 mm, to enable the base to be placed at the level of its longitudinal ends directly on the top edges of the walls forming the cavity.

In the prior art, the end edges had to be clipped widthwise of the moulded-over article between two side walls and longitudinal end walls had to be provided for the cavity sufficiently far apart to allow the passage of the article for moulding over to enable it to be clipped. Thus it was necessary to leave a small gap between the longitudinal end edges of the base and the longitudinal end walls of the cavity and this gap allowed liquid foam to infiltrate and damage some of the hooks, so that fixing of the moulded-over article to the moulded object was of poor quality. By means of the invention clipping is no longer necessary and hence the article for moulding over remains placed on the walls of the cavities, there is no longer any need to leave the said gaps, and on the contrary according to the invention excellent sealing is obtained at all the top edges of all the walls of the cavity formed at the base of the mould, without the provision of any added sealing means.

According to one specifically preferred embodiment, the base is of polyamide 6 (nylon 6) and has a thickness of between 0.2 mm and 0.4 mm.

According to a preferred embodiment, the base has a thickness of 0.15 to 0.35 mm and is of polyamide 6-6 (nylon 6-6).

Nylons have proved to be particularly suitable, particularly for sealing the cavity and providing good fixing of the moulded-over article to the moulded object.

The invention relates to also to a moulded object of foam to which one or more articles for moulding over according to the invention is/are fixed by hardening of the foam on the top surface of the base after the foam has been poured in a mould.

The invention also relates to a mould in the base of which there is made a cavity having walls projecting from the base and on the top edges of which there is intended to be placed an article for moulding over intended to be fixed to a moulded object by solidification of a foam poured from above, characterized in that the cavity has two side wall, spaced apart by a distance between 4.5 and 12 mm.

The distance between two walls is measured along the perpendicular to the wall. This relates to the width of the cavity formed between the walls in the plane perpendicular to the walls.

The invention also relates to a method of manufacturing a moulded object comprising an moulded-over article fixed to the object and having hooks projecting towards the exterior of the moulded object, characterized in that it comprises:

a) forming a cavity at the base of a mould comprising two side walls spaced apart preferably by a distance of between 4.5 and 12 mm;

b) placing an article for moulding over according to the invention on the outer top edges of the two side walls, the hooks being directed towards the interior of the cavity formed by the two side walls at the base of the mould, then c) pouring liquid foam in the mould so that it is fixed on the top surface of the moulded-over article by solidification without being able to penetrate to the interior of the cavity to damage the hooks.

The method according to the invention is particularly simple to use.

According to an improvement of the method according to the invention, it consists also in the step comprising placing the longitudinal end edges of the base on walls of the cavity, particularly two end walls, when the article for moulding over is placed on the cavity.

According to another improvement of the method, longitudinal end regions of the base have no hooks, particularly over a longitudinal distance of some millimeters to some centimeters.

BRIEF DESCRIPTION OF THE DRAWINGS

One embodiment of the invention is described in the accompanying drawings which are given solely by way of example.

PREFERRED EMBODIMENT FOR CARRYING OUT THE INVENTION

Figure 1:
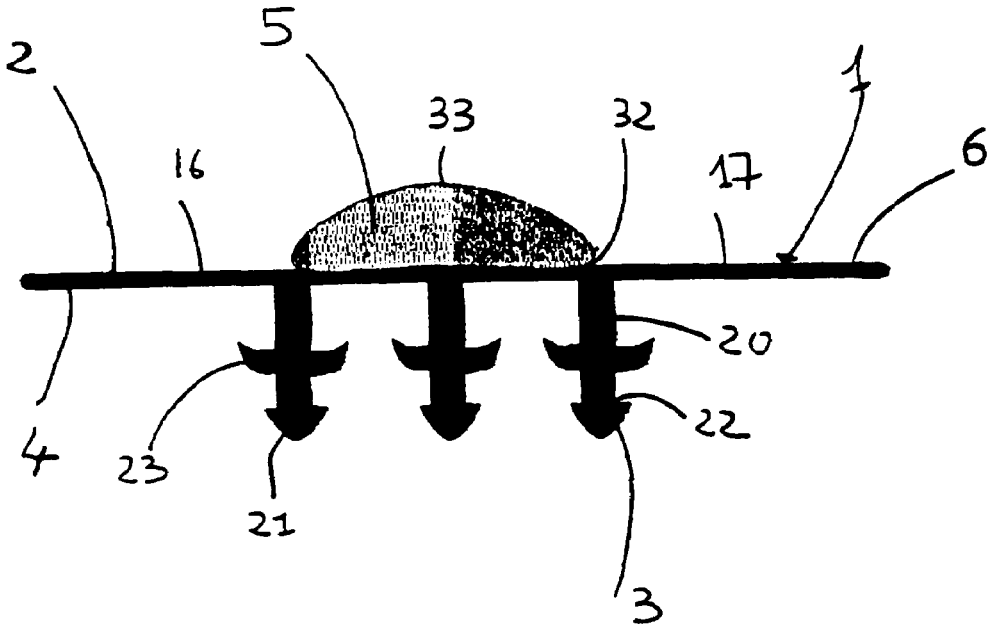
FIG. 1 is a perpendicular cross-section of an article over which a moulding is to be made according to the invention.

In FIG. 1, the article 1 over which a moulding is to be made consists of a substantially flat base 2. Hooks 3 extend from one surface 4 of the base, being disposed along a hook strip 15. Two regions 16 and 17 in the form of ledges extend on either side of the strip 15. The said two ledges 16 and 17 will be placed on the top edges of the vertical side walls of the mould (see hereinafter). These two ledges do not have hooks. A metallic resin 5 disposed in the form of a rib is fixed, particularly by gluing or simply by solidification of the resin, on the surface 6 remote from the preceding surface of the base. The hooks are disposed in rows, three rows being shown in the drawing. Generally, the base 1 has a length (in the direction perpendicular to the drawing) very much larger than its width. Similarly, the rows of hooks are disposed in a strip which is longer than it is wide. The strip of hooks 15, however, does not extend throughout the base longitudinally. In fact two regions 7, 8 are provided without hooks at the final longitudinal ends of the hook strip. These two regions 7, 8 enable the base to be placed with the hooks downwards on a cavity formed at the base of the mould, at the level of the longitudinal ends of the base 2. They have a length of 12 mm.

The hooks are of the following shape: the hook 3, of Christmas tree shape, comprises a rod 20 of rectangular cross-section, particularly square, extending from the base and terminating in a head 21 formed by a ridge having two inclined surfaces meeting at the apex, and the base of which is of a larger dimension than the cross-section of the rod, so as to form two reinforcements 22 on either side of the rod. Substantially at mid-height two hook-shaped fins 23 curved downwardly extend from the rod. These hooks are made by extrusion.

Figure 5:
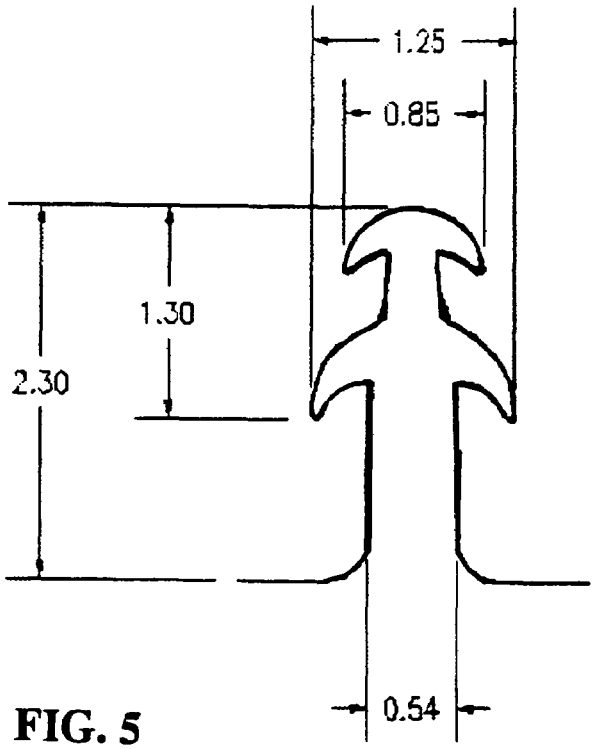
FIG. 4 is a general view of a moulded object obtained after solidification of the foam of the top surface of the base and FIG. 5 is a section of a hook extending from the base.

The total height of a hook is 2.3 mm. The width between the point furthest to the right of the right-hand fin and the point furthest to the left of the left-hand fin is 1.25 mm, particularly in the plane of FIG. 5. The width of the rod at the base is 0.54 mm. The distance in height between the apex of the hook and the point of the right or left fin is 1.3 mm. It should be noted that the rod could also be a circular cylinder with a single fin extending all around and a head of conical shape.

The width of the hook strip is between 3 and 10 mm. In the drawing it is 8 mm. The width of each ledge 16 and 17 is, for example, between 2 and 30 mm, preferably between 7 and 15 mm.

Figure 2:
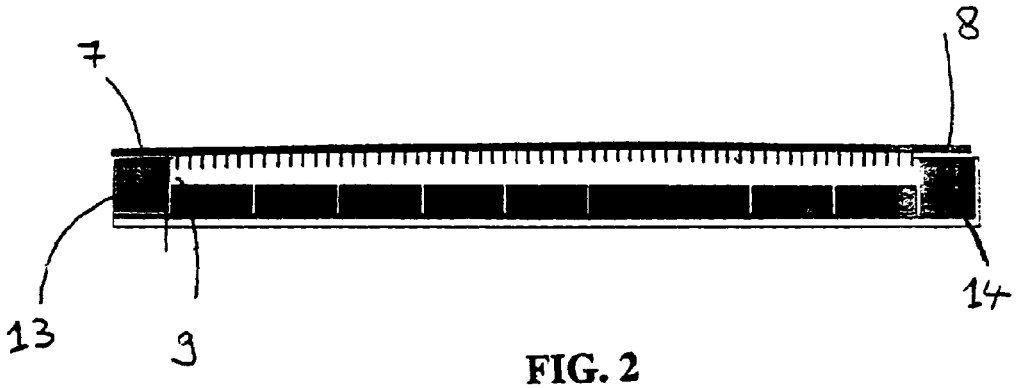
FIG. 2 is a perpendicular longitudinal section of the article for moulding over according to the invention placed on the cavity formed at the base of a mould.
Figure 3:
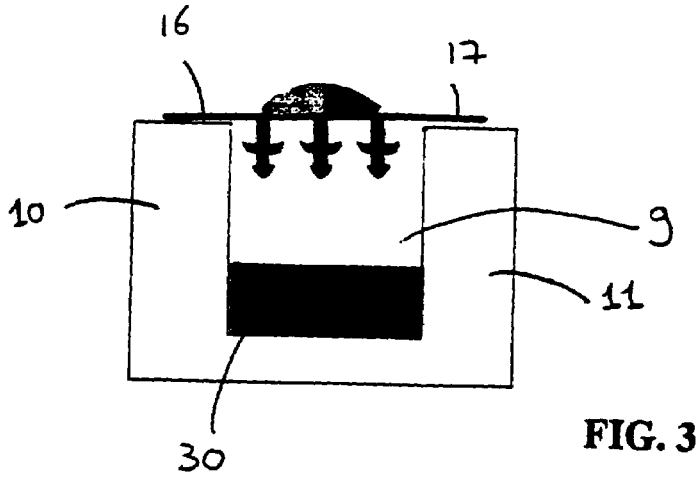
FIG. 3 is a cross-section of the article for moulding over according to the invention placed on the cavity formed at the bottom of a mould.
Figure 4:
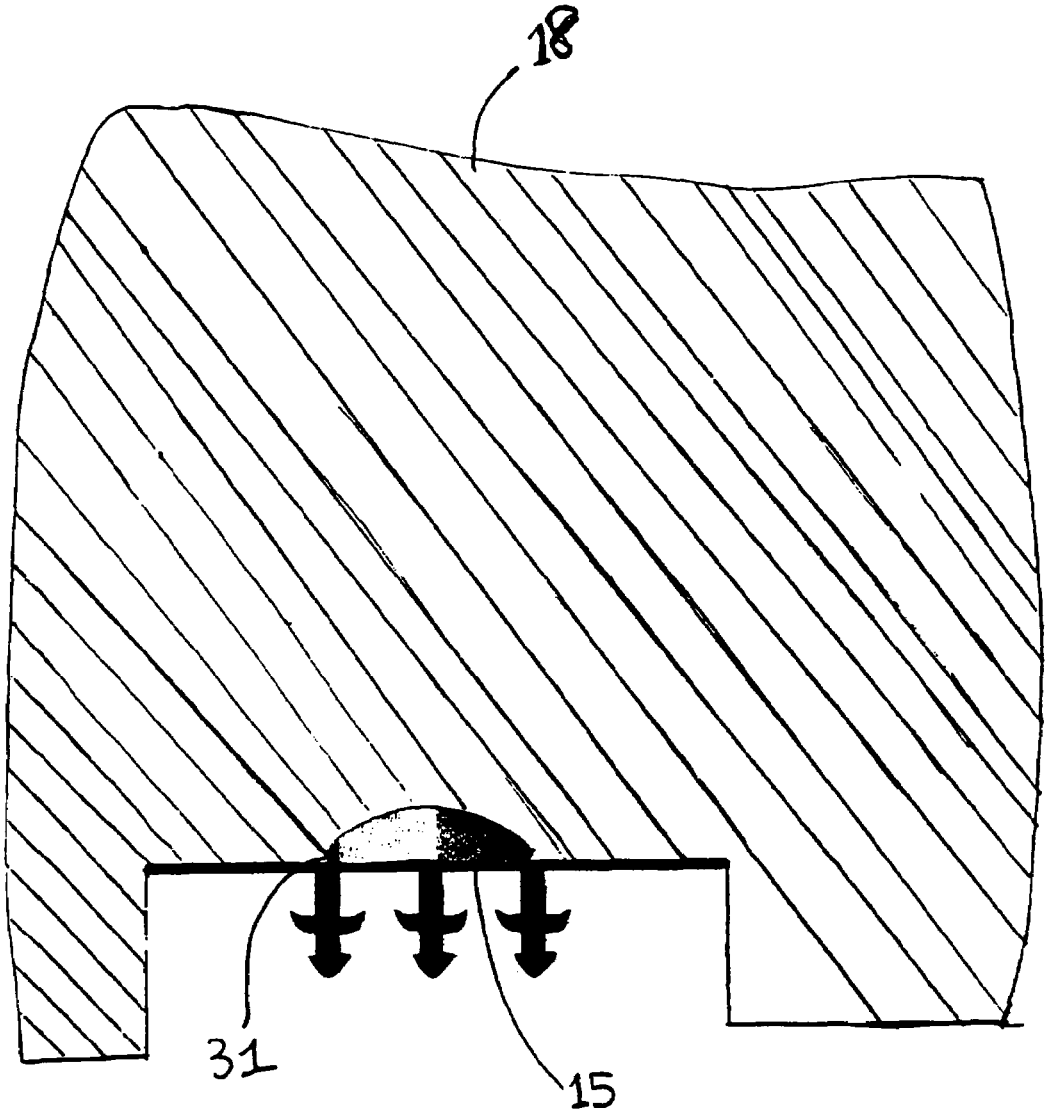

FIG. 3 shows the article over which the moulding is to be made placed with the hooks oriented into the cavity 9 formed at the base of the mould. This cavity 9 comprises in cross-section two parallel side walls 10 and 11 projecting from the base of the mould. This cavity is closed and there are also two parallel side walls 13, 14 not visible in this section but visible in FIG. 2. It is on these two walls that are placed the two regions 7, 8 without hooks at the two opposite longitudinal ends of the hook strip. The two side walls 10 and 11 of the mould are spaced apart, the spacing being less than about 12 mm, preferably less than 10 mm, for example equal to 6 mm.

The material and thickness of the base is so selected as to give sufficient flexibility to match the possible shapes of the top edges of the vertical walls 10 and 11 under the pressure of the foam that is poured thereon. A number of examples of thicknesses and materials are as follows:

Thickness=0.3 mm for a polyamide 6, at ±0.1 mm

Thickness=0.25 mm for polyamide 6-6 at ±0.1 mm.

However, the base may also be made from polyethylene, polypropylene, or any other thermoplastic or thermosetting material, particularly polyester.

The foam that is poured is a material compatible with that of the moulded-over article, i.e. it fixes well there when it solidifies in contact with the moulded-over article. In particular, it is possible to use a polyurethane or polyether foam, but other materials are of course possible.

The base 2 is placed with its surface 4 (at the level of the two ledges 16 and 17 without hooks and the regions 7 and 8 without hooks of the strip 15) on the top edges of the walls 9, 10, 13 and 14, in order thus to form the cavity 9. The foam is then poured into the mould and is left to solidify. The moulded object 18 is then withdrawn from the mould. As a result, the moulded object 18 is provided with the moulded-over article comprising hooks without foam, which hooks will, for example, be able to co-operate with the loops of a fabric in order to cover the moulded object, for example a motor vehicle seat cushion.

Disposed in the base of the cavity is a magnet 30 intended to co-operate with the metallic resin rib in order to assist positioning of the moulded-over article above the cavity. The magnets are particularly rare earth magnets (samarium-cobalt magnets).

The metallic resin is placed on the top surface in the form of ribs, two longitudinal grooves or reinforcements 31 and 32 being formed at the base-resin interface. They provide better anchoring of the moulded-over article in the foam which solidifies after penetrating therein. In order further to improve this anchoring, particularly for the smallest widths of the hook strip, it is possible to provide on the outer surface 33 of the metallic resin rib anchoring patterns formed, for example, by engraving.

The provision of the metallic resin rib is particularly advantageous compared with a metallic strip glued to the base. In fact the metallic resin better follows any undulations in the moulded-over article and does not tend to project beyond the longitudinal edges of the article over which the moulding is to be made, as is the case with a metallic strip which may injure a worker taking hold of the article to place it at the base of the mould for example.

However, for the resin to have sufficient efficacy, it must nevertheless be formed by at least 6 grams of metal powder, for example 8.4 grams per linear meter, mixed with a conventional resin of at least 4 grams per linear meter, for a total weight of metallic resin of at least 10 grams per linear meter.

What is claimed is:

1. An article over which a moulding is to be made by pouring foam on it while it is placed on top of a cavity delimited by vertical walls having top surfaces, said article comprising a base (2) having a central strip region, and ledge regions extending laterally from said central strip region, and a top surface (6) and a bottom surface (4), hooks (3) extending from said central strip region of the bottom surface (4) of the base and metallic material fixed on the top surface characterized in that the base is flat in shape, the hook strip has a width less than 10 mm, and the flat base (2) is of a material such and of a thickness such that, when said article is placed on top of the cavity, with the hooks inside the walls and facing the cavity, said bottom surfaces of said ledge regions being in contact with said top surfaces of the vertical walls during the entire formation of the moulding to provide surface to surface contact between said ledge regions and said vertical walls, wherein said central strip region of said bottom surface, from which said hooks are extending, except said hooks, is the lowest part of the article; said central strip region is flat in a transversal direction of the article and has a width measured in said transversal direction; said right and left ledge regions have respective left and right portions extending parallel to said central flat strip region when said article is placed on top of a cavity and foam is being poured on it, said right and left portions having respective left and right widths in said transversal direction; and the sum of said left and right portion widths is larger than said width of said central strip region, wherein said left and right widths of said left and right portions solely prevent foam from entering the cavity during pouring of the foam.

2. An article for moulding over according to claim 1, characterized in that the hooks (3) are made in the form of longitudinal rows and the hooks have a Christmas tree shape.

3. An article for moulding over according to claim 1, characterized in that the longitudinal strip (15) comprising hooks stops at a distance from the longitudinal ends of the base, longitudinal end regions (7, 8) thus being formed without hooks over a distance less than 15 mm, to enable the base to be placed at the level of its longitudinal ends directly on the top edges of the walls (13, 14) forming the cavity.

4. An article for moulding over according to claim 1, characterized in that the base is of polyamide 6 and has a thickness of between 0.2 mm and 0.4 mm or the base has a thickness of 0.15 to 0.35 mm and is of polyamide 6-6.

5. An article for moulding over according to claim 1, characterized in that the metallic material is embodied in the form of a metallic resin rib fixed by gluing to the top surface of the base said metallic resin rib including two longitudinal grooves on either side of the resin-base interface to provide good anchoring of the foam.

6. An article for moulding over according to claim 5, characterized in that the resin rib comprises at least 6 g per linear meter of metallic powder for a total weight of metallic resin of at least 10 g per linear meter.

7. A moulded object of foam to which one or more article for moulding over according to claim 1 is fixed by hardening of the foam on the top surface of the base after the foam has been poured in a mould.

8. A mould including a base, the base including a cavity having walls projecting from the base and the top edges of which being adapted to receive an article for moulding over according to claim 1, said article being fixed to a moulded object by solidification of a foam that is poured there over, characterized in that the cavity has two side walls, spaced apart by a distance between 4.5 and 12 mm.

9. An article over which a molding is to be made by pouring foam on it while it is placed on top of a cavity delimited by vertical walls, each having a top surface, said article comprising an element having a central strip region and left and right ledge regions, said element having a top surface and a bottom surface, hooks extending from said central strip region of the bottom surface and magnetically attractable material fixed to said element, wherein said hook strip has a width less than approximately 10 mm, said element includes a material and a thickness such that, when said article is placed on top of the cavity, with the hooks inside the walls and facing the cavity, said bottom surfaces of said ledge regions being in contact with said top surfaces of the vertical walls to provide surface to surface contact between said ledge regions and said vertical walls during the entire foam pour, and said central strip region of said bottom surface, from which said hooks are extending, except said hooks, is the lowest part of the article; wherein said central strip region is flat in a transversal direction of the article and has a width measured in said transversal direction; said right and left ledge regions have respective left and right portions extending parallel to said central flat strip region when said article is placed on top of a cavity and foam is being poured on it, said right and left portions having respective left and right widths in said transversal direction; and the sum of said left and right portion widths is larger than said width of said central strip region, wherein said left and right widths of said left and right portions solely prevent foam from entering the cavity during pouring of the foam.

10. The article of claim 9 wherein said hook strip has a width between approximately 3 and 10 mm.

11. The article of claim 10, wherein said element is flat in shape.

12. The article of claim 10, wherein said magnetically attractable material is fixed on said top surface of said element.

13. The article of claim 9, wherein said element is flat in shape.

14. The article of claim 13, wherein said magnetically attractable material is fixed on said top surface of said element.

15. The article of claim 9, wherein said magnetically attractable material is fixed on said top surface of said element.

16. An article over which a molding is to be made by pouring foam on it while it is placed on top of a cavity delimited by vertical walls, each having a top surface, said article comprising an element having a central strip region and left and right ledge regions, said element having a top surface and a bottom surface, hooks extending from said central strip region of the bottom surface and magnetically attractable material fixed to said element, wherein said hook strip has a width less than approximately 10 mm, said element includes a material and a thickness such that, when said article is placed on top of the cavity, with the hooks inside the walls and facing the cavity, said bottom surfaces of said ledge regions being in contact with said top surfaces of the vertical walls during the entire formation of the moulding to substantially prevent the foam from entering the cavity, and said central strip region of said bottom surface, from which said hooks are extending, except said hooks, is the lowest part of the article; wherein said central strip region is flat in a transversal direction of the article and has a width measured in said transversal direction; said right and left ledge regions have respective left and right portions extending parallel to said central flat strip region when said article is placed on top of a cavity and foam is being poured on it, said right and left portions having respective left and right widths in said transversal direction; and the sum of said left and right portion widths is larger than said width of said central strip region, wherein said left and right widths of said left and right portions solely prevent foam from entering the cavity during pouring of the foam.

17. An article over which a molding is to be made by pouring foam on it while it is placed on top of a cavity delimited by vertical walls having top surfaces and a magnet disposed in the bottom of the cavity, said article comprising an upper surface and a bottom surface and having a central strip region and ledge regions extending laterally from said central region, hooks extending from said bottom surface of said central region, and metallic material being fixed to said article, wherein said central strip region of said bottom surface, from which said hooks are extending, except said hooks, is the lowest part of the article, said article being in such a material and having such a thickness that when said article is placed on top of the cavity with the hooks inside the walls and facing the cavity with the magnet and when foam is poured on said article, said bottom surfaces of said ledge regions are in contact with said top surface of the vertical walls during the entire foam pour to provide surface to surface contact between said ledge regions and said vertical walls; wherein said central strip region is flat in a transversal direction of the article and has a width measured in said transversal direction; said right and left ledge regions have respective left and right portions extending parallel to said central flat strip region when said article is placed on top of a cavity and foam is being poured on it, said right and left portions having respective left and right widths in said transversal direction; and the sum of said left and right portion widths is larger than said width of said central strip region, wherein said left and right widths of said left and right portions solely prevent foam from entering the cavity during pouring of the foam.

* * * * *